United States Patent [19]

Congdon

[11] 4,268,912

[45] May 19, 1981

[54] DIRECTIONAL HYDROPHONE SUITABLE FOR FLUSH MOUNTING

[75] Inventor: John C. Congdon, Fort Wayne, Ind.

[73] Assignee: Magnavox Government and Industrial Electronics Co., Fort Wayne, Ind.

[21] Appl. No.: 912,918

[22] Filed: Jun. 6, 1978

[51] Int. Cl.[3] ..... H04R 17/00

[52] U.S. Cl. ..... 367/163; 310/337; 310/365; 310/366; 367/164; 367/174

[58] Field of Search ..... 367/160, 161, 163, 164, 367/149, 174; 310/337, 365, 366

[56] References Cited

U.S. PATENT DOCUMENTS

| | | | |
|---|---|---|---|
| 2,105,010 | 1/1938 | Sawyer | 367/164 |
| 2,967,957 | 1/1961 | Massa | 367/164 |
| 3,202,962 | 8/1965 | Elston | 367/160 |
| 3,271,596 | 9/1966 | Brinkerhoff | 367/160 |
| 3,510,698 | 5/1970 | Massa | 367/160 |

*Primary Examiner*—Harold Tudor

*Attorney, Agent, or Firm*—W. J. Iseman; W. J. Streeter; T. A. Briody

[57] ABSTRACT

A substantially flat and disc-like shaped sound transducer for sensing sound waves in a fluid transmission medium and having directional and omnidirectional response characteristics to the sound waves. The sound transducer having a circular vibratile plate divided into quadrantal portions and having a surface adapted to be coupled to the transmission medium for providing sound wave motion in the portions dependent upon, and in response to, sound wave travel in the transmission medium and having a plurality of electroacoustic transducer elements coupled to the quadrantal portions of the vibratile plate for providing electrical output signals in response to the wave motions in diametrically opposed quadrantal portions. The sound transducer responding to incident sound waves having wavefront travel directions, in the transmission medium, substantially parallel to the coupled surface. The relatively flat physical configuration of the sound transducer makes it especially suited for flush mounting in a surrounding surface, such as the hull of a ship or submarine.

8 Claims, 11 Drawing Figures

DIRECTIONAL HYDROPHONE SUITABLE FOR FLUSH MOUNTING

BACKGROUND OF THE INVENTION

1. Field of Invention

The present invention relates to a sound transducer and more particularly to a substantially flat and circular configured hydrophone having directional and omnidirectional response characteristics and which is especially suited for use in applications requiring a directional hydrophone capable of being flush mounted in a surrounding surface.

2. Description of the Prior Art

Hydrophones having directional characteristics for use in determining direction of propagation of incident sound waves are well-known in the art. These prior art devices range from relatively large directional arrays of two or more spaced hydrophones to directional hydrophones housed in a single and relatively small package.

In the conventional prior art spaced array, identical but separate pressure sensitive omnidirectional hydrophone transducers are placed apart in the water transmission medium and electrically connected so as to provide the desired directional characteristics. Accuracy of these arrays depends to a large extent upon a close match of the individual hydrophone sensitivities under various environmental conditions such as, for example, temperature and static pressure. These arrays normally measure the acoustic pressure differential between the spaced hydrophone positions, and the signal outputs of the individual hydrophone transducers are combined to provide output signals bearing a sine and/or cosine like function of the angle of incidence of the incident sound waves, as is well-known to those skilled in the art. The combined signal output is a function of transducer spacing as well as the angle of incidence. Ideally these arrays use hydrophone spacings of one-eighth wavelength or less of the sound wave of interest in the sound transmission medium in order to provide a differential combined output signal having a true sine or cosine response pattern. This requirement thus tends to restrict the frequency range over which a given configured array will provide true response patterns and yet provide adequate signal output levels. Lower operational frequencies generally require arrays of larger physical configurations.

Most shipboard or sonobuoy applications require directional hydrophones configured in a single relatively small package. Many prior art hydrophones meet this requirement. Typical of these latter-mentioned devices are the cylindrical, reed, and spherical-type directional hydrophones, examples of which are respectively disclosed in U.S. Pat. No. 3,496,527 issued to Ziehm and entitled "Transducer for Determining the Angle of Incidence of Sound Waves"; U.S. Pat. No. 3,603,921 issued to Dreisbach and entitled "Sound Transducer"; and U.S. Pat. No. 3,732,535 issued to Ehrlich and entitled "Spherical Acoustic Transducer".

Although the latter-referenced hydrohones, as well as other similar prior art devices, are capable of satisfactory operation and are suitable for some shipboard and sonobuoy applications, they are not ideally suited for use in applications where it is desirable that the hydrophone be flush mounted in a surrounding surface such as the hull of a vessel. The inherent nature of these prior art hydrophones requires that the acoustical sensitive or active surfaces of the hydrophone be surrounded by the water transmission medium. Placing such type hydrophones within a well or recess in a surrounding mounting surface affects the effective coupling betwween the hydrophone's active surfaces and the main of the acoustic transmission medium and, in addition, can create a discontinuity of the transmission medium surrounding the hydrophone as well as the creation of multiple sound transmission paths in the transmission medium within the recess, all of which can result in degradation of the hydrophone performance. Use of these same prior art hydrophones extending beyond the surrounding mounting surface is also disadvantageous since such protrusion not only adversely affects the hydrodynamic characteristics of the outside surface of the hull but also makes the protruding hydrophone highly susceptible to physical damage. In addition, the ambient noise output levels of these prior art hydrophones when so mounted are usually undesirably high due to the flow of water about the protruding hydrophone structure. It is thus apparent that such prior art directional hydrophone devices are not ideally suited for certain seaborne applications.

SUMMARY OF THE INVENTION

In view of the foregoing, it is an object of the present invention to provide an improved hydrophone having directional and omnidirectional characteristics. It is another object of the present invention to provide a directional hydrophone having the capability of being flush mounted in a surrounding surface. It is yet another object of the present invention to provide a directional hydrophone having a main acoustic active surface which is in a plane parallel to the mounting surface. It is still another object of the present invention to provide a directional hydrophone having a main acoustic active surface for sensing acoustic wave front travel in planes substantially parallel to the main surface. It is another object of the present invention to provide a directional hydrophone having a plurality of transducer elements coupled to a disc shaped vibratile plate. It is still another object of the present invention to provide a directional hydrophone having a plurality of piezoelectric electroacoustic transducer elements which are inherently closely matched in sensitivity. These and other objects of the present invention will be apparent from the following descriptions and accompanying drawings.

In accordance with one hydrophone embodiment of the present invention, there is provided a circular vibratile plate or disc or piezoelectric transducer material having first and second surfaces respectively located in substantially parallel planes on opposing sides of the disc and having coupled to the first surface a plurality of four separate piezoelectric transducer electrodes and having coupled to the opposing second surface a single piezoelectric transducer electrode common to the four separate electrodes. The four separate electrodes having identical shapes and areas and symmetrically positioned around a center point of the first surface and positioned equal distances from each other. Each different one of the four electrodes is located in a different one of four quadrants of the disc surface for providing four electroacoustic transducer elements, each different one respectively responding to vibrations in each one of the four quadrants of the vibratile disc and providing in response thereto piezoelectric generated electrical output signals between the four respective electrodes and the common electrode.

There is also provided a flat circular metal plate having a circular hole concentrically located within for receiving the vibratile disc and providing a baffle and inertial mass for the vibratile disc. The plate additionally provides a means of mounting the vibratile disc within a surrounding adjacent surface.

In operation, one surface of the vibratile plate or disc is coupled to the water sound transmission medium for responding to wave front travel in the medium including sound wave travel in directions substantially parallel to the planes of the disc surfaces and in response thereto, for providing complex vibrations in the disc which vary as a function of the direction of the wave front travel in the medium. The vibrations in the disc are sensed by the transducer elements which provide electrical output signals in response thereto. The resultant electrical output signals from each pair of the transducer elements related to diametrically opposite ones of the four quadrants of the disc are combined to provide output voltages which vary substantially as sine and cosine functions of the angle of wave front travel of the incident sound waves in the transmission medium. The electrical output signals of all four transducer elements of the two respective pairs of elements can also be combined to provide a resultant electrical signal having omnidirectional characteristics to the wave front travel in the medium.

In another embodiment of the invention, the vibratile plate or disc is comprised of a circular metal plate having separate piezoelectric transducer elements affixed to the plate.

DESCRIPTION OF THE PREFERRED EMBODIMENTS

Figure 1:
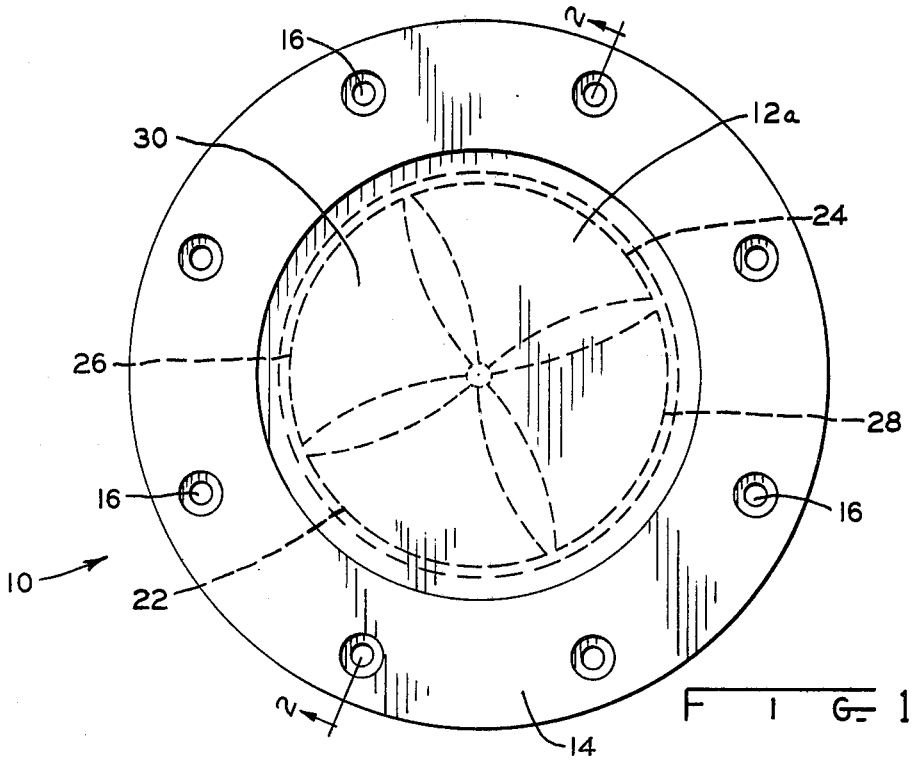
FIG. 1 is a top view of a directional hydrophone in accordance with the present invention.

In the following description of the present invention and the accompanying drawing figures, like reference characters designate like parts and functions throughout.

Referring first to FIG. 1, there is shown a pictorial view of a hydrophone 10 in accordance with the present invention. The hydrophone 10 comprises a disc-shaped vibratile plate assembly 12 which is positioned within and affixed to a ring-shaped mounting plate 14. The mounting plate or ring 14 having a plurality of peripherally located holes 16 for use in mounting the hydrophone 10 to a surrounding structure for providing acoustic coupling of the vibratile plate or disc 12 with a water sound transmission medium.

Although the vibratile plate or disc 12 can be one of several possible configurations within the spirit of the present invention, the vibratile plate 12 shown in FIGS. 1 and 2 and hereinlater described in greater detail with reference to FIG. 4 briefly comprises a flat circular metal plate or disc **12*a* to which is coupled a flat disc of piezoelectric material 12*b*. The piezoelectric disc 12*b* having a plurality of four separate and identically shaped piezoelectric transducer electrodes 22, 24, 26, 28 coupled thereof on a side of the disc 12*b* opposite that side coupled to the metal plate 12*a*. The four electrodes 22, 24, 26, 28 are positioned, one in each of four quadrants of the piezoelectric disc 12*b*. In operation of the hydrophone 10, at least one of two surfaces 30,32 of the vibratile plate 12 is acoustically coupled to the water sound transmission medium for providing resultant vibrations in the vibratile plate 12. As will be later apparent, the vibrations in the vibratile plate 12 resulting from sound energy in the transmission medium are a function of and dependent upon the direction of the incident sound wavefront travel of the sound waves in the coupled transmission medium relative to the attitude of the four quadrants of the vibratile plate 12. The resultant vibrations in each one of four quadrants of the vibratile plate 12 providing electrical output signals between each respective one of four electrodes 22, 24, 26, 28 and the metal plate 12*a*. The metal plate 12*a* in addition to being, in part, acoustically coupled to the transmission medium also provides a transducer electrode common to the four separate transducer electrodes 22, 24, 26, 28**.

The circular vibratile plate 12 is affixed near its outer peripheral edge to the inner periphery of the mounting plate or ring 14. The mounting ring 14 thus provides a means for supporting the vibratile plate 12 and facilitates the mounting of the hydrophone 10 and vibratile plate 12 to a surrounding structure. Mounting ring 14 additionally provides an inertial mass immediately surrounding and affixed to the vibratile plae 12. As will be later apparent, the hydrophone 10 is especially suited for mounting to a surrounding structure or surface such as the hull of a ship or submarine in which case the hull will provide additional inertial mass to a degree greater than that provided by the mounting ring 14 itself. The mounting ring 14 can therefore be of any suitable material such as, for example, aluminum, steel, or copper.

Figure 2:
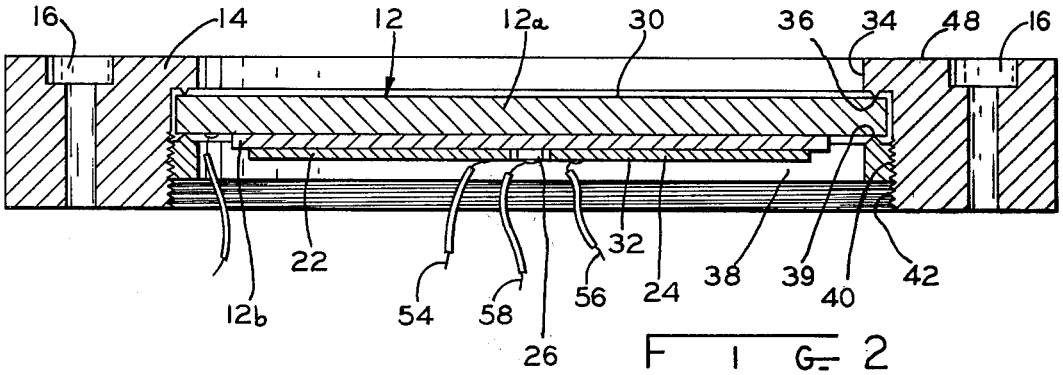
FIG. 2 is a cross-sectional view of the invention taken along the lines 2–2 of FIG. 1.

Referring now to FIG. 2 for a better understanding of the configuration of the combined vibratile plate 12 and the mounting ring 14, there is shown a cross-sectional view of the hydrophone 10 of FIG. 1 taken along the lines 2—2. The mounting ring 14 additionally comprises an inner flange 34 having ridged surface 36, against which a mating surface of the vibratile plate 12 is seated. The circular vibratile plate 12 is captivated or clamped, fulcrum like, near its outer periphery, between the ridged surface 36 of inner flange 34 and a similar ridged surface 39 on threaded retaining ring 38. External screw threads 40 on the outer perimeter of the retaining ring 38 mate with internal screw threads 42 on the mounting ring 14. The vibratile plate 12 can be affixed to the mounting ring 14 by means other than that described above. As alternatives, for example, the ridged surfaces 36 and 39 can be omitted and replaced with suitable "0" rings or other types of resilient gasket means of a suitable material such as, for example, polychloroprene can be positioned or applied between the mating surfaces of the vibratile plate 12 and the adjacent surface of the flange 34 as well as the adjacent mating edge surface of the retaining ring 38. The use of such a resilient means can provide a fulcrum-like type of support for the outer edges of the vibratile plate 12 with respect to the supporting mounting ring surrounding the vibratile plate 12. In addition, with the ridged surfaces 36 and 39 omitted, the outside diameter of the circular vibratile plate 12 and the diameter of the circular hole within the mounting ring 14 which receives the vibratile plate 12 can be of such dimensions that a "force" type mechanical fit exists between the received vibratile plate 12 and the mounting ring 14 and/or the vibratile plate 12 can be secured within the receiving hole of the mounting ring 14 by use of a suitable adhesive or cement such as an epoxy applied near the outer edge of the vibratile plate 12. When these latter-described alternatives are used, the retaining ring 38 and the screw threads 40, 42 are not required and can be omitted. Methods of securing or affixing the vibratile plate 12 within the mounting ring 14, other than those described herein, will be obvious to those skilled in the art without departing from the spirit of the invention.

As will now be apparent, the vibratile plate 12 is received within the mounting plate or ring 14 and affixed thereto. The mounting ring 14 surrounds the outer periphery of the vibratile plate 12 so as to allow vibrational coupling of at least one of the surfaces 30, 32 of the vibratile plate 12 with the water sound transmission medium. It should be understood that the type of mounting and the rigidity with which the edges of the vibratile plate 12 are secured to the mounting ring 14 can affect the vibrational damping of, and vibrational pattern in, the vibratile plate 12 and can thus affect the sensitivity and/or frequency response of the hydrophone 10 as may be desired. In one constructed embodiment of the present invention, the vibratile plate 12 was secured within and to the mounting ring 14 using the aforementioned "force" or "pressed" fit.

It will be apparent to those skilled in the art that the vibratile plate 12 of the present invention, when used as a hydrophone, be provided with a means of protection from the surrounding water sound transmission medium. Although such protection means is not shown in the accompanying drawings, it is desirable that the piezoelectric material, transducer electrodes, and electrical connecting leads be enclosed or encapsulated with a suitable protective material. It is preferred that the protective material be of a flexible nature and have desired attributes of transmitting acoustical energy with relatively little energy attenuation or distortion and that the material and its configuration provide a reasonably good acoustical impedance match between the vibratile plate and the sound transmission medium. The material when placed or positioned against the transducing material and associated electrodes and electrical connections must, of course, be of an electrically non-conductive material. In addition, it is preferred that the protective material be highly resistant to the surrounding water and also be capable of withstanding long periods of exposure to the surrounding water without a degradation of its protective qualities and desired attributes.

Castable polymers can be used, for example, to provide the above-described protection of the hydrophone against the sea water sound transmission medium. One such polymer of a polyurethane type, identified as PR-1538, is manufactured by the Products Research and Chemical Corporation of Burbank, Calif. This material can be applied on the exposed surfaces of the vibratile plate 12. To provide additional protection, suitable elastomers such as, for example, a neoprene rubber can be bonded to the exterior surface of the above-referenced castable polymer during the curing stage of the polymer. Neoprene boots can also be used to confine an electrical non-conductive fluid, such as a castor oil or one of various available silicone fluids, over the surface of the vibratile plate 12. Other types of materials and methods of application for providing suitable protection of the hydrophone will be apparent to those skilled in the art.

Figure 3:
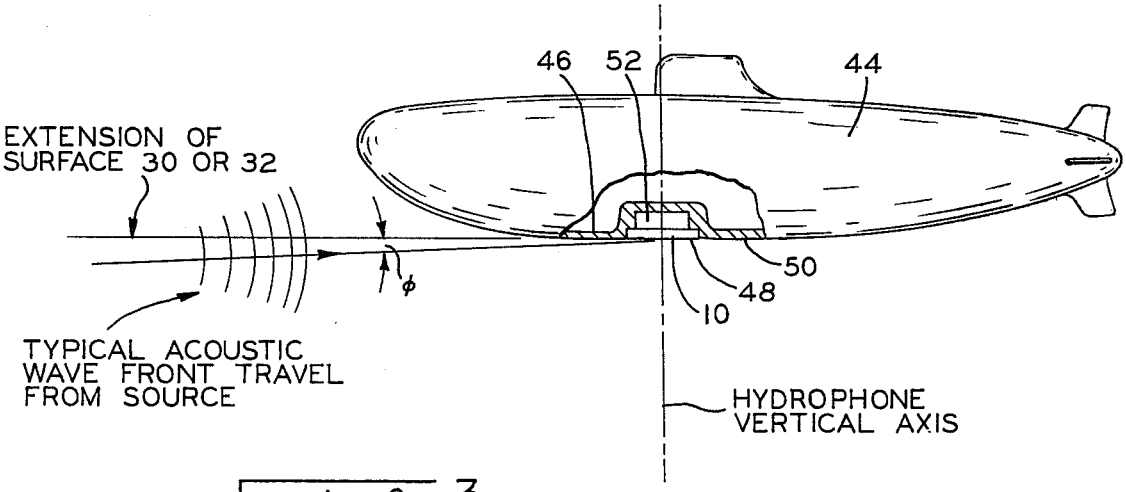
FIG. 3 shows a typical flush mounted application of a directional hydrophone in accordance with the present invention.

Referring now to FIG. 3, there is illustrated a typical flush mounted application of the directional hydrophone 10 in the hull of a submarine 44. FIG. 3 shows a representation of a submarine 44 and a partial cross-sectional view of the submarine hull 46. Hull 46 could, however, represent a hull of a conventional ship. The hydrophone 10 and the immediately surrounding structure of the hull 46 are shown in an enlarged scale relative to the submarine 44 in order to clarify the mounting details. The hydrophone 10 can be recessed slightly in the hull 46 if desired to provide a full flush mounting of the hydrophone 10 within the hull 46; thus the surface 48 of the hydrophone mounting ring 14 can be substantially in the same plane as the outside surface 50 of the hull 46 surrounding the hydrophone 10. Either one of the hydrophone surfaces 30 or 32, as desired, can be used as the main acoustic active surface and therefore be acoustically coupled to the seawater sound transmission medium. Although not a requirement for operation of the hydrophone 10, it is preferred that the back surface of the vibratile plate 12 be exposed to the sea water pressure in order to equalize static water pressure against both surfaces 30,32 of the vibratile plate 12. This can be provided by a cavity 52 in the hull 46 and a small cross-sectional passageway, not shown, communicating between the cavity 52 and the seawater sound transmission medium on the outside of the hull 46. The cross-sectional dimension of this passageway is relatively small compared to the wavelength of the acoustic sound waves of interest. Thus, the passageway provides for a relatively high attenuation of the acoustic sound waves yet allows the relatively slow varying static pressures to be transmitted to within the cavity 52. This passageway can be a part of the mounting ring or can be a part of the cavity structure in the hull, as desired. Suitable bolts, not shown, protrude through the holes 16 in the mounting ring 14 and can be threaded into mating threaded holes, not shown, in the submarine hull or cavity structure. The back surface of the hydrophone 10 can also be airbacked and the cavity 52 sealed from the external sea water with suitably placed "O" rings. The cavity can also be filled with a non-conducting fluid such as a castor oil or a silicone fluid to provide compensation for the hydrostatic pressure of the seawater transmission medium. The cavity 52 behind the vibratile plate 12 of hydrophone 10 should be sufficiently large to provide a low acoustic stiffness and thus minimally affect operation of the hydrophone 10. Other methods of mounting the hydrophone 10 to the hull 46 can, of course, be used and will be apparent to those skilled in the art.

Because the metal plate 12*a* of the vibratile plate 12 provides a common transducer electrode, it can, if desired, be placed electrically at the same potential as that of the seawater in which case it need not be electrically insulated from the seawater. The four electrodes 22, 24, 26, 28 and their associated electrical leads should, however, be insulated from the seawater.

Figure 4:
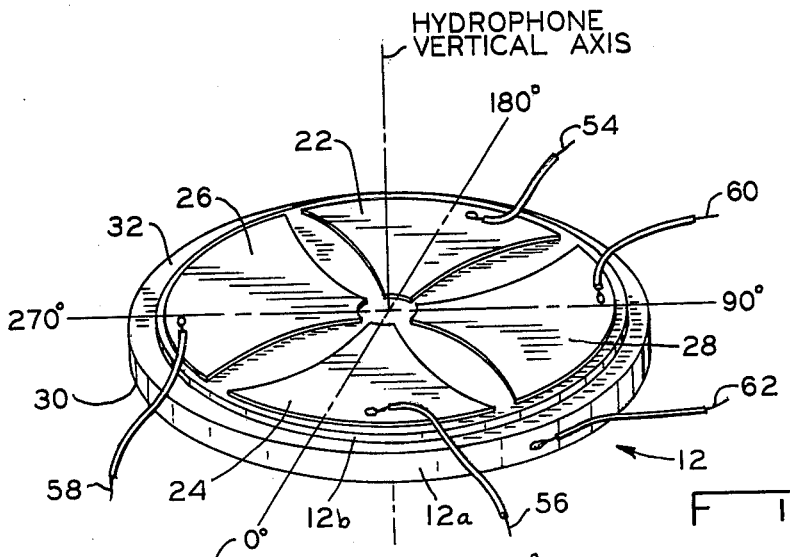
FIG. 4 is a pictorial view showing a four transducer element vibratile plate in accordance with the present invention and used in the invention shown in FIG. 1.
Figure 11:
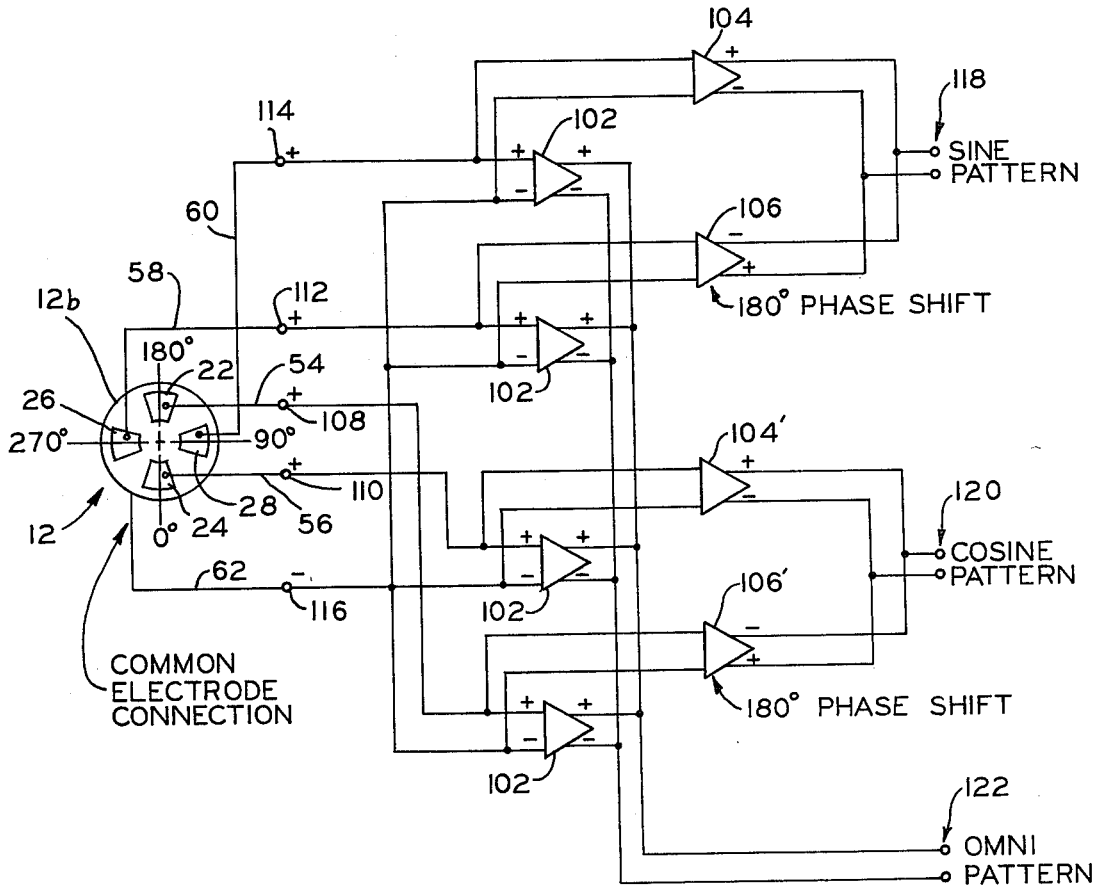
FIG. 11 shows a circuit diagram for combining the output signals of a hydrophone made in accordance with the present invention and suitable for providing the directivity patterns shown in FIG. 8.

Referring to FIG. 4, there is shown a pictorial view of the vibratile plate 12 shown in FIGS. 1 and 2. The vibratile plate 12 of FIG. 4 comprises a disc 12*b* of piezoelectric material having two substantially flat and parallel surfaces and having the circular metal plate 12*a* electrically and mechanically coupled to one of the flat surfaces and having four separate and individually located electrodes 22, 24, 26, 28, identical in shape and surface area, coupled to the other one of the two surfaces of piezoelectric disc 12*b*. The piezoelectric disc 12*b* can comprise any one of a number of well-known materials exhibiting a piezoelectric effect when the disc 12*b* is subjected to a bending, flexure, or thickness shear type of mechanical action. The piezoelectric disc 12*b* can, for example, be of a lead zirconate titanate material and can be constructed such as a Bimorph (trademark) type bender element as is well-known in the piezoelectric transducer art. The electrodes 22, 24, 26, 28 can comprise a plating of silver on the surface of the piezoelectric material. Metal plate 12*a* is coaxially positioned upon disc 12*b* and provides a means of mounting the vibratile plate 12 within the mounting ring 14 as shown in FIGS. 1, 2. Metal plate 12*a* also provides an electrode common to each one of the respective individual electrodes 22, 24, 26, 28. Suitable leads 54, 56, 58, 60 are electrically connected to the respective individual electrodes 22, 24, 26, 28 and lead 62 is electrically connected to the metal plate 12*a* in order that the so-formed electroacoustic transducers can be connected to external combining circuitry such as shown in FIG. 11. Vibrations in the vibratile plate 12, resulting from sound waves in the transmission medium coupled thereto, provide electrical output signal voltages to appear between each one of the leads 54, 56, 58, 60 and the common lead 62. The four individual electrodes 22, 24, 26, 28 are symmetrically positioned on the surface of the piezoelectric disc 12*b* to provide each one of the four piezoelectric transducer elements so formed, in a different one of four quadrants of the piezoelectric disc 12*b* and vibratile plate 12. The transducer output signals are thus indicative of the vibrations in each one of the four quadrants.

The vibratile plate 12 is capable of responding to sound wave travel in the coupled transmission medium which travel is in planes substantially parallel to the planes of the surfaces 30 and 32 of the vibratile plate 12 such as is illustrated by FIG. 3. Because of this capability, the hydrophone 10 is ideally suited for flush type mounting as previously described. Combining the output signals of a pair of transducer elements located in diametrically opposite quadrants of the vibratile plate 12 provides a resultant signal which varies substantially as a sine or cosine function of the angle $\theta$ formed between the direction of wave travel in the transmission medium and a reference axis comprising a center line passing through the center point of the vibratile plate 12 and the two electrodes of a diametrically opposing pair of transducers such as, for example, 22, 24, of FIG. 4. It will be obvious that a cosine function is provided when the zero degree reference axis passes through the electrodes associated with a given pair of transducers as exemplified above and a sine function provided when the zero degree reference axis is at 90 degrees to the axis passing through the electrodes of the given pair of transducers. Two pairs of transducers can provide the familiar double-figure-8 pattern as shown in drawing FIG. 8 and described in more detail hereinafter.

Figure 5:
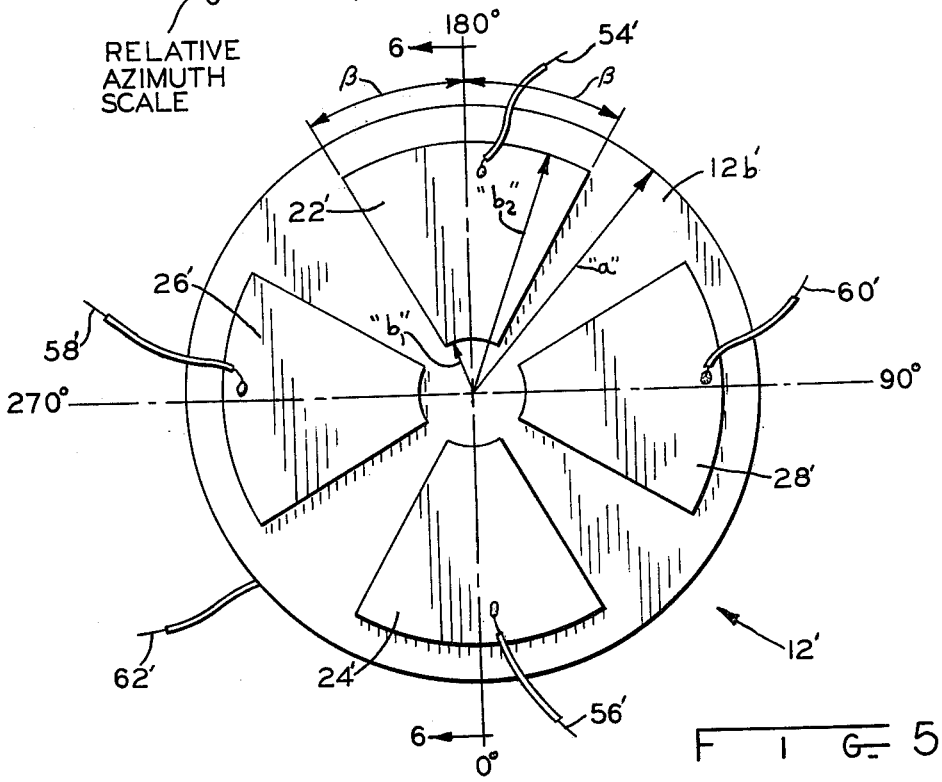
FIG. 5 is a top view of another embodiment of a four transducer element vibratile plate in accordance with the present invention and suitable for use in the hydrophone shown in FIG. 1.

Referring now to FIG. 5, there is shown another embodiment of a vibratile plate in accordance with the present invention. In FIG. 5, as well as FIGS. 6 and 7 to follow, the like reference characters designate like parts and functions throughout. The vibratile plate 12' shown in FIG. 5 can be used in lieu of vibratile plate 12 shown in FIG. 4, in the hydrophone 10 of FIGS. 1 and 2. When used as such, the vibratile plate 12' is affixed to the mounting ring 14 as previously described with relation to the vibratile plate 12. Vibratile plate 12' as shown by FIG. 5 comprises a piezoelectric disc 12*b'* having electrodes 22', 24', 26', 28' on one surface 32' thereof and having a common electrode 64 on the opposing surface 30'. The common electrode 64 is identical in function and purpose as the common electrode which is provided by the metal plate 12*a* of vibratile plate 12. Electrical leads 54', 56', 58', 60' are attached to the respective electrodes 22', 24', 26', 28' and lead 62' is likewise attached to the common electrode 64 for providing connections to signal-combining circuitry such as shown, for example, by FIG. 11. Based upon the previous description of the vibratile plate 12 of FIG. 4, it will be apparent that vibratile plate 12' of FIG. 5 operates in a like manner to provide like electrical output signals. Two pairs of transducers such as shown in FIG. 5 can thus provide the previously referenced double "figure-8" response pattern shown in drawing FIG. 8.

Figure 6:
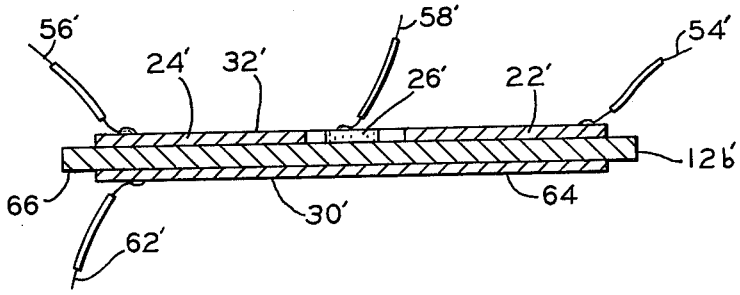
FIG. 6 is a cross-sectional view taken along the lines 6—6 of FIG. 5.

FIG. 6 is a cross-sectional view of vibratile plate 12' of FIG. 5 taken along lines 6—6. The vibratile plate 12' can be affixed to the mounting ring 14 near the outer peripheral edge 66 of the disc 12*b*.

Figure 7:
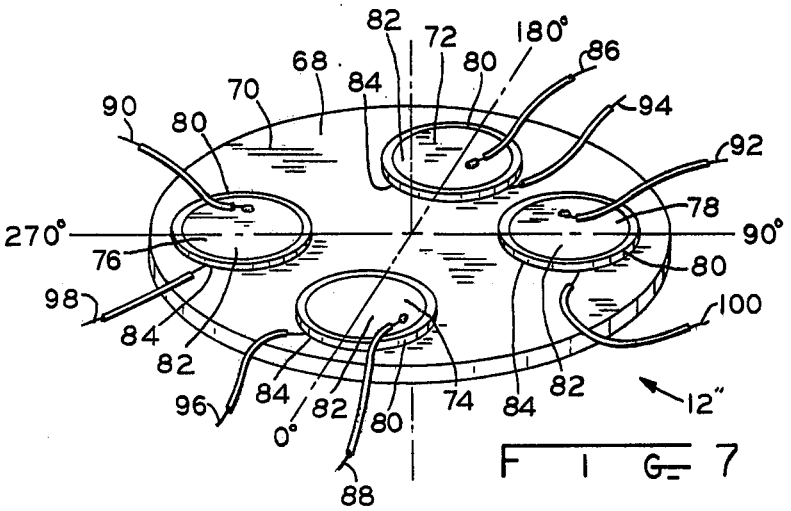
FIG. 7 shows a further embodiment of a four transducer element vibratile plate in accordance with the present invention and suitable for use in the hydrophone shown in FIG. 1.

FIG. 7 shows still another embodiment of a vibratile plate in accordance with the present invention. The vibratile plate 12" shown in FIG. 7 can be used in the hydrophone 10 of FIGS. 1, 2 in lieu of the vibratile plate 12 shown. The vibratile plate 12" shown in FIG. 7 comprises a disc or plate 68 of a suitable material such as aluminum having a substantially flat surface 70 upon which is affixed electro acoustic transducers 72, 74, 76, 78. The transducers 72, 74, 76, 78 are symmetrically positioned on the surface 70 for providing a transducer in each one of four quadrants of the disc 68. The transducers 72, 74, 76, 78 can be affixed to the surface 70 of disc 68 using an epoxy or other suitable attachment means to provide a uniform mechanical bond between each one of the transducers 72, 74, 76, 78 and the disc 68. When the disc or plate 68 is of an electrically conductive material, the transducers 72, 74, 76, 78 can, if desired, be suitably insulated from the plate 68. The transducers 72, 74, 76, 78 can be of any desired type such as a piezoelectric type shown and described. Each one of the transducers 72, 74, 76, 78 comprise a circular plate 80 of piezoelectric material, similar to that shown and described in relation to the vibratile plates of FIGS.

4 and 5, and having two substantially flat and parallel surfaces. The piezoelectric plate 80 of each one of the transducers 72, 74, 76, 78 having a first piezoelectric transducer electrode 82 on one surface thereof and having a second electrode 84 on the opposing surface. The electrodes 82 and 84 can be of a silver or other similar electrically conductive plating material on the piezoelectric plate 80 as is well-known in the piezoelectric transducer art. Electrical leads 86, 88, 90, 92 are suitably connected to the first electrode 82 of each one of the transducers 72, 74, 76, 78 respectively and electrical leads 94, 96, 98, 100 are likewise connected to the second electrode 84 of each one of the transducers 72, 74, 76, 78 respectively for providing electrical connection to external hydrophone circuitry as previously described with relation to the vibratile plates of FIGS. 4 and 5. Each one of the transducers 72, 74, 76, 78 are identical in size and shape. It should be understood that the transducers 72, 74, 76, 78 of the FIG. 7 embodiment react to the vibrations in the disc 68 in the same manner as previously described, for example, with relation to the transducers associated with the electrodes 22', 24', 26', and 28' and disc **12*b*' of the FIG. 5** embodiment.

The vibratile plate 12'' of FIG. 7, like the vibratile plates 12 and 12', can be affixed to the mounting ring 14 of the hydrophone 10 as previously shown and described. It is preferred that the piezoelectric transducers 72, 74, 76, 78, as well as the transducers of the previously described vibratile plates 12 and 12', be identically poled so that each transducer of the vibratile plate as, for example, transducers 72, 74, 76, 78, provide an output voltage of the same polarity on the connection leads 86, 88, 90, 92 and an output voltage of an opposite polarity on connection leads 94, 96, 98, 100 when each one of the transducers 72, 74, 76, 78 is subjected to an identical deflecting force. It should be understood that either all of the connection leads 86, 88, 90, 92 or the connection leads 94, 96, 98, 100 can, if desired, be connected together to provide a common electrode connection such as provided by the lead 62 or 62' of the FIG. 4 and 5 vibratile plate embodiments, respectively. When the transducers use separate electrode leads as shown in FIG. 7, the outputs of the transducers such as those located in opposite quadrants can be conveniently connected in series aiding or series opposing as may be desired; however, it should be understood that to provide a sine or cosine response pattern, the transducers be connected in a series opposing fashion. To provide a series opposing output from the transducers 72, 74, the leads 94 and 96 can be connected together with an output taken between leads 86 and 88. Transducers 76, 78 can obviously be connected in a like series opposing manner. When such transducer output connections are used, the combining circuit shown by FIG. 11 and described herein later need not be used to provide directional response patterns.

Figure 8:
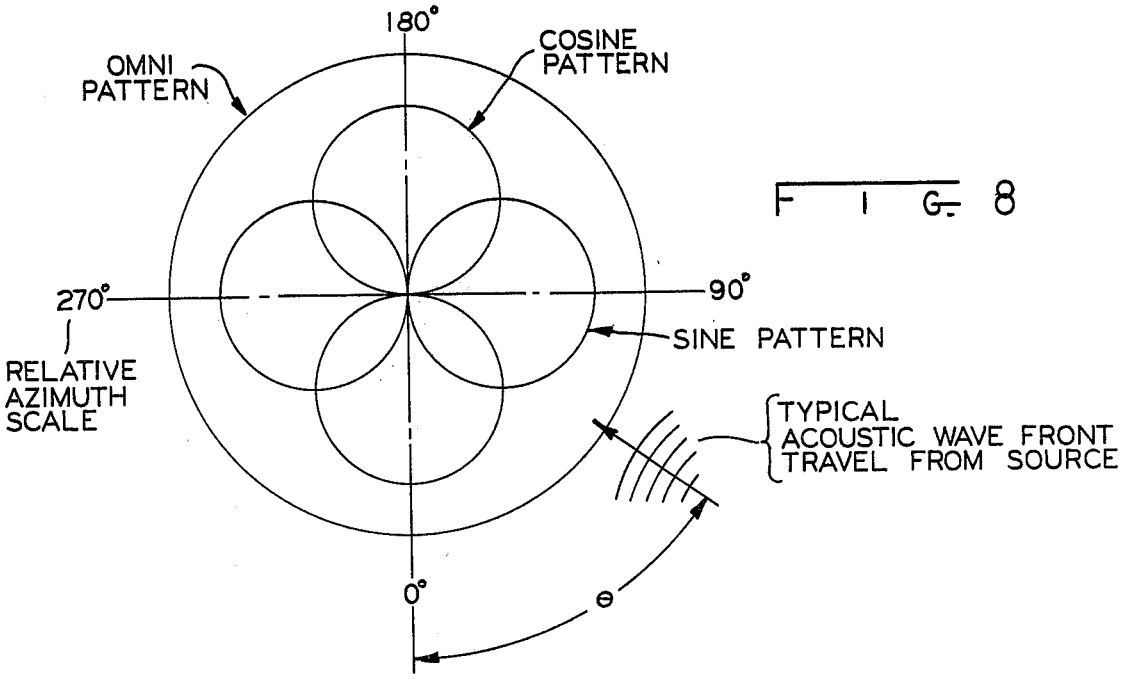
FIG. 8 shows typical planar directivity patterns which can be obtained with a hydrophone made in accordance with the present invention.

FIG. 8 illustrates typical directional and omnidirectional response patterns which can be provided by a hydrophone in accordance with the present invention. Simultaneous sine and cosine responses, commonly referred to as a double "figure-8" pattern, can be obtained using a vibratile plate having four electroacoustic transducers such as the vibratile plates 12, 12', and 12'' shown in FIGS. 4, 5, and 7 respectively. It will be obvious to those skilled in the art, that a single "figure-8" pattern can be provided, using a vibratile plate having only two transducer elements. The single "figure-8" pattern can be either a sine or cosine function. The directional response patterns shown by FIG. 8 are substantially sine and cosine functions of the azimuth angle $\theta$ as shown. The angle $\theta$ represents the angle of arrival of incident acoustic waves relative to the vibratile plate for acoustic wave fronts traveling in planes substantially parallel with the main surfaces of the vibratile plate, such as surfaces 30, 32 of FIG. 4, or where the vertical angle $\phi$ of arrival of the wave front as shown by FIG. 3 is equal to or near zero degrees. Although the directional response patterns of the hydrophone are useful for angles of $\phi$ other than substantially zero degrees, the sine and cosine response functions are progressively degraded as the angle $\phi$ approaches and reaches 90 degrees. At 90 degrees, the sine and cosine outputs are at a null. The omni response pattern is substantially constant with varying angles of $\phi$.

It will be apparent that the directional response pattern provided by the present invention and shown in FIG. 8 is like that obtained with the previously referenced spaced pressure hydrophone array having spacings of one-eighth wavelength or less. In these prior art spaced arrays, ideally the only acoustic transmission or coupling medium existing between the individual pressure-sensitive transducers is that of the surrounding water sound transmission medium itself. In a hydrophone in accordance with the present invention, the individual transducers are coupled to one another by means of the vibratile plate 12 and therefore the individual transducer elements do not operate as physically or acoustically isolated transducers. The transducer elements of the vibratile plate 12 such as shown, for example, in the FIG. 4 and 5 embodiments can be defined as those portions of the piezoelectric disc **12*b* which are associated with the respective electrodes 22, 24, 26, and 28. The transducer elements of the present invention are therefore an inherent part of the vibratile plate 12 which, for example, in the FIG. 4 embodiment is comprised of the piezoelectric disc 12*b*, metal plate 12*a* and electrodes 22, 24, 26, and 28, all of which operate as a complete and integral vibrating structure. It should be noted that velocity of sound wave travel in the vibratile plate 12 will be greater than the velocity in the surrounding water sound transmission medium; thus a wavelength of a given sound wave will be physically longer in the vibratile plate 12 than the wavelength of the same sound wave in the water transmission medium coupled to the vibratile plate or disc 12**. A hydrophone in accordance with the present invention can thus provide a true cosine response with effective transducer element spacings which are much greater in terms of a wavelength in the water transmission medium than is possible with the prior art pressure sensitive spaced array. A hydrophone in accordance with the present invention having substantially the same overall physical size of a given prior art spaced array is capable of cosine operation over a greater range of frequencies than is practical to obtain with the spaced array.

The vibrational stresses set up with the vibratile plate 12 as a result of the sound pressure waves in the sound transmission medium coupled to the vibratile plate 12 are a function of a number of parameters of the vibratile plate 12 and operating conditions and include, for example, properties of the materials comprising the vibratile plate 12 as well as physical dimensions of the constituent parts of the plate, the methods of support and constraints of the vibratile plate, the frequency of operation, and resultant vibration standing waves within the plate. These vibrational stresses and their distribution in the plate are well-known and appear in any disc subjected to external sound wave pressures such as might exist in a sound transmission medium coupled to the disc. This same stress distribution would exist, for example, in a disc-shaped pressure transducer of a prior art spaced array as previously referenced. In this latter spaced array, for example, the many existing stresses in the disc are averaged and supplied as a single transducer output signal, whereas in the present invention the stresses at predetermined locations on the disc are transduced into a number of output signals, each one representing the resultant stresses in a different one of the predetermined locations on the disc.

Although the resulting vibrations in the vibratile plate 12 are quite complex, their analysis can be considerably simplified with the aid of modern computers. Basic vibrational theory of disc-like structures such as the vibratile plate 12 is taught, for example, by Timoshenko and Woinowsky-Krieger in "Theory of Plates and Shells," published 1959 by McGraw-Hill. Computer analysis can be accomplished with techniques such as taught by Zienkiewicz in "Finite Element Method in Engineering Science," published 1971 by McGraw-Hill.

A functional relationship of various parameters affecting the sensitivity of a hydrophone in accordance with one possible configuration of the disclosed invention is illustrated in the expression which follows. This expression is an approximation of the relationship of the sensitivity to the various parameters. It is a result of an analytical evaluation of the voltage differential existing between a pair of piezoelectric transducers located in diametrically opposed quadrants of a vibratile disc, similar to that shown for example in FIGS. 5 and 6, and generated by a force acting upon the surface of the disc, the force having a gradient or slope which varies in a substantially linear fashion across the surface of the disc. This is believed to be a reasonable approximation of what occurs in practice when the disc is subjected to an acoustic wave transversing the surface of the disc where the wavelength of the acoustic wave is large compared to the diameter of the disc and where the disc is clamped in a fulcrum-like fashion near its outer periphery such as, for example, shown in FIG. 2.

It should be understood that the expression is an approximation and although it can be useful in optimizing the sensitivity of a hydrophone having the above-stated conditions, the invention is not limited to these conditions. Other possible hydrophone configurations as disclosed herein and within the spirit of the invention will provide directional properties; however, the resultant sensitivities may not be in accordance with this expression. It will be obvious to one skilled in the art that, for example, a disc or vibratile plate which is rigidly clamped or secured at its outer periphery will have a resultant stress or vibrational pattern different from that obtained with the above-described fulcrum-like clamping and as such, a modified expression for sensitivity reflecting this difference would necessarily apply.

$$S \propto V\left\{\left(\frac{b_2}{a}\right)\left[\frac{\frac{2(5+\sigma)}{3}\left[1-\left(\frac{b_1}{b_2}\right)^2\right]-\frac{3(3+\sigma)}{5}\left(\frac{b_2}{a}\right)^2\left[1-\left(\frac{b_1}{b_2}\right)^5\right]}{\left[1-\left(\frac{b_1}{b_2}\right)^2\right]}\right]\right\}\left(\frac{\sin\beta}{\beta}\right)(\cos\theta)$$

where:

S—is the relative sensitivity of the hydrophone or the ratio of the differential output voltage to the mechanical input force applied to the disc.

V—represents functions to which the transducer output voltage is directly related and, for example, involves a relationship of parameters such as Young's Modulus and Poisson's Ratio of the piezoelectric material, the piezoelectric material thickness and radical dimensions and the piezoelectric material constant.

$\oplus$—represents Poisson's Ratio of the vibratile disc or piezoelectric material $\beta$—is an angular segment expressed in radians of the electrodes as shown in FIG. 5.

a, $b_1$, $b_2$—are relative radial dimensions of the disc and electrodes such as shown in FIG. 5.

$\theta$—is an angle of arrival of the acoustic wavefront relative to a center line axis passing through the response pattern such as shown in FIG. 8.

Although various of the parameters in the above expression are specifically defined with respect to FIG. 5, it should be understood that this is by way of example only. It will be obvious to those skilled in the art that these parameters are equally applicable to other configurations of the vibratile plate and disc shown in other of the accompanying drawing figures.

Figure 9:
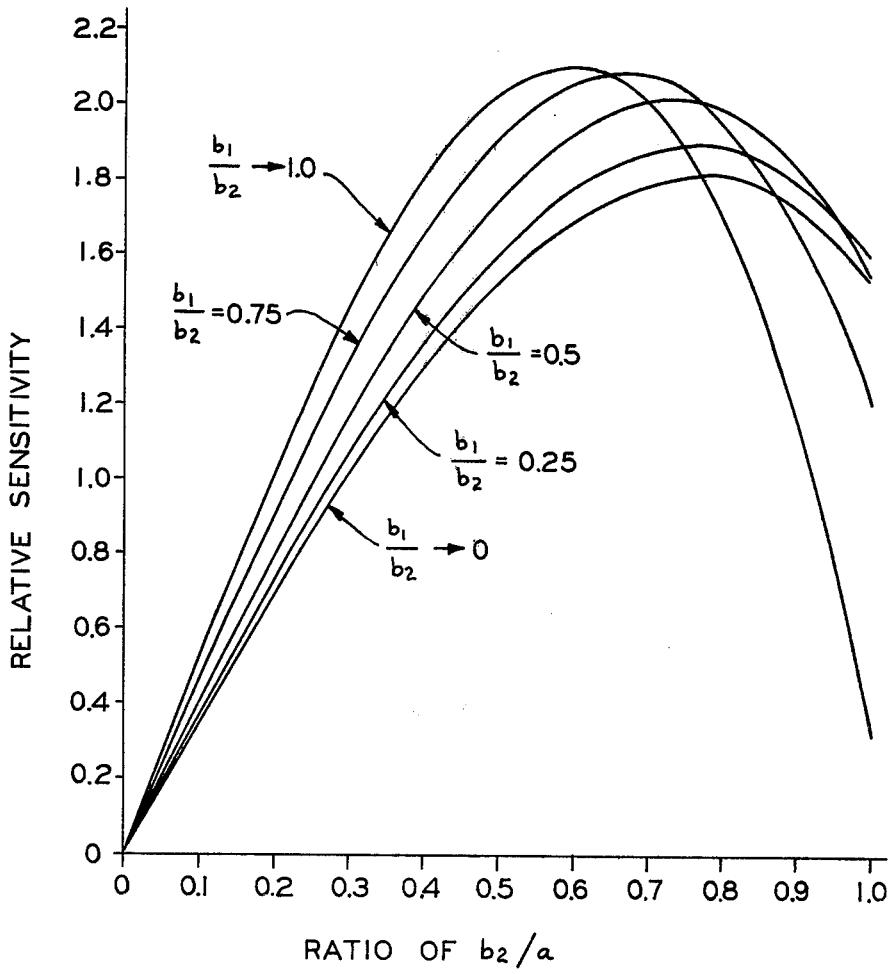

When in the above-defined relationship, fixed values greater than zero are assumed for the parameters of V, $\beta$, $\delta$, and cos $\theta$, the relative sensitivity of the hydrophone can be expressed in a series or family of curves in terms of the ratios of $b_1/b_2$ and $b_2/a$ as shown in FIG. 9. In the family of curves shown in FIG. 9, the ratio $b_2/a$, representing the radial dimensions of the electrode and disc, are plotted as abscissas with the relative sensitivity plotted as ordinates. Each curve of the family represents a different value of the ratio of $b_1/b_2$.

Figure 10:
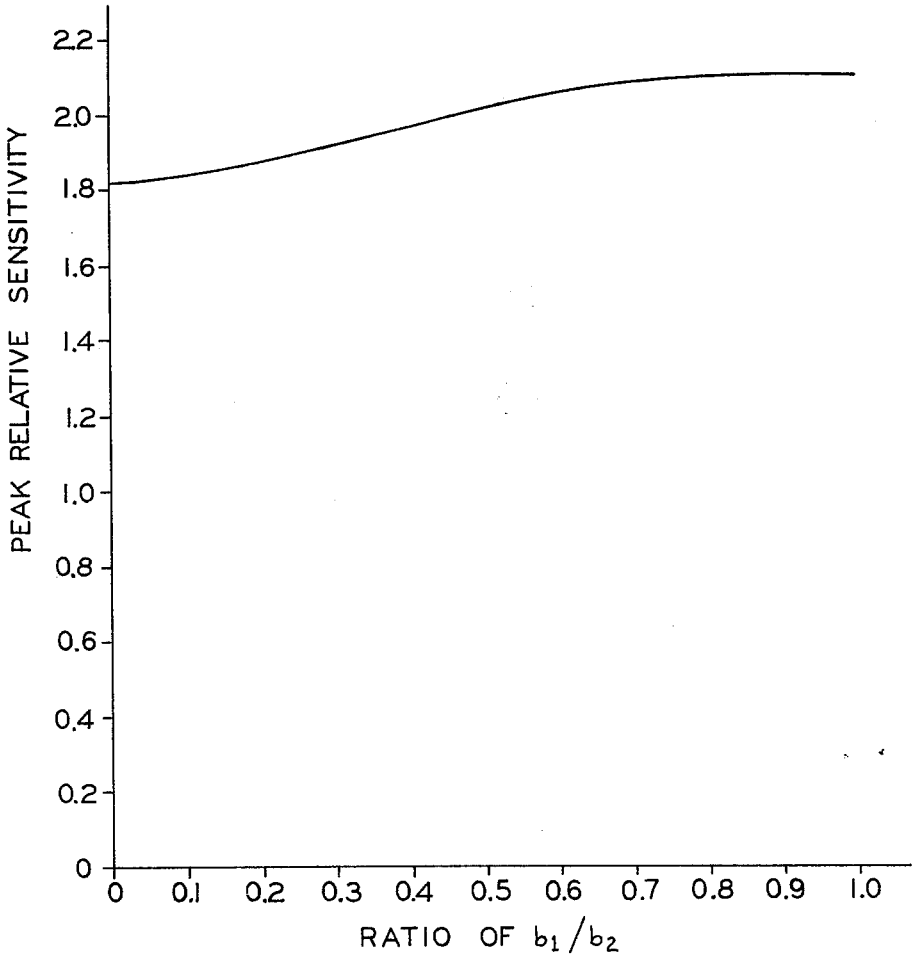
FIGS. 9 and 10 show graph plots of the relative sensitivities of a hydrophone in accordance with the present invention and indicate the trend in variations of the sensitivity with variations of certain indicated parameters of the hydrophone.

Referring now to FIG. 10, there is shown a single curve plot of the peak relative sensitivity value of each one of the family of curves shown in FIG. 9. In the curve shown in FIG. 10 the peak relative sensitivities are plotted as ordinates with the ratios of the $b_1/b_2$ plotted as abscissas.

The curves shown in FIGS. 9 and 10 indicate the sensitivity tendency relative to the radial dimensions of the electrodes and piezoelectric disc or vibratile plate. As previously mentioned, however, and as will hereinlater be more apparent, deviations in this trend can and most likely will occur with changes such as in the mounting of the disc or plate to its support means and the presence of resonant frequency vibrations in the disc or plate.

The above-defined relationship illustrates relative sensitivity trend under a condition in which the vibratile plate or disc is free of natural resonant frequencies. If, however, resonant frequencies are within the frequency range of operation of the hydrophone, additional stresses are set up in the vibratile plate 12 which can result in degradation of performance. Some resonances, however, if not severe, will not be adverse to the sensitivity or directivity. In instances where the hydrophone is to be used in narrow frequency band application, the resonant frequencies can be more easily placed outside the frequency band of interest. On the other hand, a resonant frequency may be placed within the bandpass to increase the sensitivity providing degradation of the directional response does not occur. The effect of existing resonances can be reduced by placing the pairs of electrodes at locations on the plate or disc so that the stresses created by the resonant conditions are averaged out in the differential combining of the signal outputs of the associated transducer elements.

It should be understood that the various constructions of the vibratile plate 12 such as exemplified in the embodiments shown in FIGS. 4, 5, and 7 can provide different relative coupling coefficients and hydrophone sensitivities as well as shifts in mechanical resonant frequencies, which can, if desired, be used to advantage for certain hydrophone applications while still maintaining the previously described sine and/or cosine directional response patterns.

As is apparent from the above-defined relationship, the relative sensitivity of the hydrophone is dependent upon the arc $2\beta$ encompassed by the electrodes. This function is quite broad up to angles of $\beta$ having a value of $\pm 45$ degrees. As an example, a minimal arc having a value of $\beta$ approaching zero degrees would have little effect upon the relative hydrophone sensitivity since $(\sin \beta/\beta)$ under this condition is close to its maximum value of unity. As $\beta$ increases to 45 degrees, the value of the bracketed function decreases to approximately 0.9. If $\beta$ is further increased to 90 degrees, the value of the bracketed function would approach approximately 0.6 which is equivalent to an approximate 6 dB decrease in relative sensitivity. This latter example is, of course, limited to a hydrophone having only two transducer elements. Since the arc $2\beta$ has minimal effect upon the relative gain of the hydrophone, the arc $2\beta$ can be selected to provide a desired capacity value of the transducer electrodes. The electrodes 22, 24, 26 and 28 can have curved or straight edges, as may be desired, and shown, for example, in FIGS. 4 and 5 respectively.

It will now be apparent that the various vibrational modes in the vibratile plate 12 as well as its resonant frequencies can be changed by altering the dimensions of the plate 12*a* and/or disc 12*b*, relative to the wavelength of sound waves in the materials of the plate 12*a* and disc 12*b*. Changing the physical dimensions of the plate 12*a* and/or disc 12*b* and the dimensions of the electrodes as well as their locations on the vibratile plate can affect the sensitivity and directional properties of the hydrophone 10. These dimensions can thus be varied to provide optimized or desired properties. The areas of the electrodes such as, for example, 22, 24, 26, and 28 can be varied to provide a desired capacitive reactance of the associated transducers. In one constructed embodiment of hydrophone 10, the electrode shape was substantially like that shown in FIG. 4. The linear dimension across the tips of the large end and also across the narrow end of each electrode was 0.5 inch and 0.188 inch respectively. The piezoelectric disc 12*b* was 0.872 inch in diameter and 0.013 inch in thickness. The metal aluminum plate 12*a* was 1.145 inches in diameter and 0.030 inch in thickness. These dimensions, although not necessarily optimum, provided satisfactory sine, cosine, and omnidirectional responses.

Now referring to FIG. 11, there is shown a schematic circuit for electrically combining the output signals of the vibratile plate transducers. The plus and minus signs shown on the various indicated leads of the schematic indicate relative voltage polarities when each transducer is separately subjected to a given identical mechanical movement or stress. The combining circuit of FIG. 11 provides a mathematical combining and averaging of the individual transducer outputs to provide simultaneous cosine, sine, and omnidirectional pattern signals. Obviously, if only a two-element or two-transducer hydrophone is used, then only that portion of the circuit associated with the two transducers is required. The use of two transducers will provide a sine or a cosine output and an omni output.

The electrical output signals from each one of the electroacoustic transducers associated with the respective electrodes 22, 24, 26, 28 are supplied as input signals to the combining circuit shown in FIG. 11. Hydrophone output signals developed between each one of the electrodes 22, 24, 26, 28 and the common electrode provided by plate 12*a* of vibratile plate 12 are applied to the input terminals 108, 110, 112, 114 and the common input terminal 116 respectively via leads 54, 56, 58, 60 and common lead 62, respectively. The output signals from each one of the transducers are applied as input signals to a corresponding one of amplifiers 102 as shown. The outputs of each one of the amplifiers 102 are connected in parallel and in turn connected to the omnidirection signal output terminals 122 of the combiner. The amplifiers 102 are substantially zero phase shift amplifiers and can provide a gain greater or less than 1 as desired. Amplifiers 102 provide an averaging of the output signals from all of the transducers of the vibratile plate 12 for supplying an omnidirectional output signal at terminals 122. The output signals from transducers associated with electrodes 28 and 26, which are positioned in diametrically opposing quadrants of the vibratile plate 12, such as located along the 90–270 degree azimuth axis, are also supplied as input signals to amplifiers 104 and 106, respectively. In a like manner, the outputs of the transducers associated with electrodes 24 and 22 are supplied as input signals to amplifiers 104' and 106' respectively. The amplifiers 104 and 104' can be identical to the previously described amplifiers 102. The amplifiers 106 and 106' can also be identical to amplifiers 102 except amplifiers 106 and 106' each provide at its output a 180 degree phase shift of its input signal. The outputs of amplifiers 104 and 106 are connected in parallel and are in turn connected to the sine directional output terminals 118 of the combiner. Amplifiers 104 and 106 thus provide an algebraic addition of the output signals of the transducers associated with electrodes 26, 28 for supplying a sine directional output signal at terminals 118. The amplifiers 104' and 106' operate in a like manner, using the output signals from the opposing quadrant transducers associated with electrodes 24 and 22 located along the 0–180 degree azimuth axis, to provide a cosine directional output signal at terminals 120.

If an omnidirectional signal output is not desired, the amplifiers 102 may be omitted. If only a two-transducer vibratile plate is used, then only that portion of the FIG. 11 circuitry associated with the two transducers is required. It is preferred that the gain of all amplifiers 102, 104, 104', 106, 106' be identical when the sensitivities of all transducers are identical. The gain of each of these amplifiers may, however, be adjusted or varied in order to compensate for any differences which might exist in the sensitivity of each one of the different transducers of the vibratile plate.

In lieu of averaging the electrical signal outputs of each one of the transducers associated, for example, with the electrodes 22, 24, 26, and 28 of FIG. 5 to provide an omnidirectional output signal, an additional and electrically separate electrode or transducer can be positioned on the vibratile plate 12 or disc 12*b* to provide an omnidirectional output signal directly. In the FIG. 5 embodiment, for example, the additional omnidirectional electrode can be circular in shape and can be located on and in the center of the disc 12*b*′ within the circular space defined by the inner radius $b_1$, of the electrodes 22′, 24′, 26′, and 28′. With this described hydrophone configuration, the combining circuit shown in FIG. 11 is not required to provide the omnidirectional output signal. Other electrode shapes and locations on the vibratile plate can be used for the omnidirectional transducer.

The directional and omnidirectional signals provided by a hydrophone in accordance with the present invention disclosed herein can be used as input signals in any desired "use" or "processing" circuitry for indicating a direction of an acoustic sound source with or without rotation of the hydrophone. As an example, the processing circuit can utilize the sine and cosine responses of the hydrophone to compute the arc tangent of the angle of arrival of the incident sound waves. The directional sine and/or cosine outputs of the hydrophone can also be combined with the omnidirectional output to form a resultant cardioid pattern which is useful in eliminating bearing ambiguity. Such "use" circuits are well-known in the art and are not described herein.

The present invention has been described and exemplified with relation to its use as a directional hydrophone transducer for the receiving or sensing of acoustic energy in a water transmission medium; it is not, however, limited to such use. The present invention can be used as a transducer for either receiving or transmitting acoustic energy and can be used in acoustic transmission mediums other than water, such as air, for example. The invention can also be used at frequencies other than those normally encountered in hydrophone uses. The words "sound" and "acoustic" as used herein are meant to include acoustic energy having frequencies within the audible range as well as frequencies beyond the audible range. The words "propagation" and "wave travel" are meant to include the travel of sound waves through or along a medium and including alterations in pressure, stress, particle displacement and the like to which the vibratile plate and associated transducers react.

Although the present invention has been described in relation to several particular embodiments shown by way of example, it should be understood that such descriptions are illustrative of the invention and are not intended to be restrictive thereof. As an example, the shape of the electrodes need not be as shown, and can take other various shapes optimized for a desired output. The common electrode such as shown in FIGS. 4 and 6 can have a shape different than the circular shape shown. In lieu of the common electrode shown, individual electrodes for each transducer can be used. The number of transducers on the vibratile plate may be of a greater or lesser number than described and shown. The surface of the vibratile plate can be reversed in the mounting ring. As an example, the surface 30 of the vibratile plate 12 as shown in FIG. 2 can be interchanged with surface 32 by reversing the attitude of the vibratile plate 12 within the mounting ring 14.

The outer periphery of the vibratile plate or piezoelectric disc can also be rigidly secured or clamped to its support means in lieu of a fulcrum-like attachment such as, for example, shown in FIG. 2. Such rigid clamping will affect the stress distribution in the plate or disc which in some applications of the hydrophone may be desirable. The plate or disc can also be supported at or near its center point, in an umbrella fashion, thus allowing the outer periphery to be free and unrestricted. In addition, other connections and/or methods of combining the outputs of the vibratile plate transducers can be used to provide the directional and omnidirectional hydrophone outputs. The combining of the outputs of the transducers can be provided, for example, by simply connecting the transducer output leads in series opposing fashion as desired.

Numerous other changes, modifications, and adaptations of the disclosed invention can be made by those having ordinary skill in the art without departing from the spirit of the invention. It is intended that such changes, modifications, and adaptations of the invention will be within the scope of the following appended claims.

What is claimed is:

1. A directional hydrophone having a main surface plane for sensing in a liquid transmission medium acoustic wave travel in planes substantially parallel to the main plane, comprising:

a plate having a main surface bounded by an outer peripheral edge, said main surface parallel to and defining the main surface plane and adapted to be coupled to the liquid transmission medium for providing mechanical stresses in the plate in response to the acoustic wave travel traversing said main surface in the coupled transmission medium, the plate having portions therein and having a center point on said main surface and a major axis parallel to said main surface and passing through said center point;

a first electroacoustic transducer element coupled to a first portion of the plate for activation by the stresses in said first portion and providing a first electrical output signal in response thereto;

a second electroacoustic transducer element coupled to a second portion of the plate for activation by the stresses in said second portion and providing a second electrical output signal in response thereto, said first and second portions having a spaced-apart relationship and each one located diametrically opposite the center point and equal-distant therefrom, said major axis bisecting said first and second portions, the first and second transducer elements being identical to each other for providing identical output signals in response to substantially identically applied stresses; and means for subtractively combining said first and second electrical signals for producing a resultant signal dependent upon a difference in said stresses in the spaced-apart first and second plate portions and varying as a cosine-like function of the direction of said acoustic wave travel transversing said surface relative to said major axis.

2. The hydrophone of claim 1 including means for mounting to a surrounding surface structure further comprising a support means and means for fastening said plate to said support means near the peripheral edge of said plate, said support means having an outer flange adapted for mounting to said surrounding surface structure for providing a substantially flush relationship between the main surface of said plate and the surrounding surface.

3. The hydrophone of claim 1 wherein said means for combining and said first and second electroacoustic transducer elements comprise respective first and second piezoelectric elements, each one of the piezoelectric elements having a respective pair of output electrodes and each one of the piezoelectric elements producing substantially equal output voltages at said respective pairs of output electrodes in responses to substantially equal stresses, one electrode of each pair being electrically common with each other, each one of the piezoelectric elements having identical polarization with respect to said common electrodes and providing at the remaining electrodes of each said pair of electrodes a series opposing combination of the respective pairs of said output electrodes wherein equal transducer output voltages resulting from substantially equal stresses in said plate portions are cancelled and whereby the hydrophone provides said cosine-like signal in response to said acoustic wave travel.

4. The hydrophone of claim 3 further comprising third and fourth piezoelectric transducer elements coupled to respective third and fourth portions of said plate for providing a resultant output signal which varies as a sine-like function of the direction of acoustic wave travel relative to said major axis.

5. The hydrophone of claim wherein the plate is of uniformly polarized piezoelectric sound transducing material.

6. An apparatus for sensing direction of propagation of sound waves in a fluid transmission medium, comprising:

a plate means having a relatively flat surface and having predetermined portions therein and a center point, said portion having a spaced-apart relationship and each one located diametrically opposite the center point and equal-distant thereform, the plate means adapted to be coupled to the fluid transmission medium for providing sound wave motions in said portions in response to sound wave propagation transversing said surface, said sound wave motions in said portions indicative of the direction of propagation of the sound waves in the transmission medium;

at least one pair of identical electroacoustic transducers, each one of the transducers of the pair coupled to a respective one of the predetermined portions for providing respective electrical output signals in dependence upon said wave motions in each of said respective predetermined portions; and subtractive combining means for combining the output signals from each said pair of identical transducers for producing a respective resultant signal which varies as a function of the direction of said sound wave travel propagation transversing said plate.

7. The apparatus of claim 6 wherein said electroacoustic transducers comprise two pairs of identical piezoelectric transducers and wherein the predetermined portions of said plate means have respective centers spaced one from the other at intervals of 90 degrees around a center point of said plate means and equally spaced from said center point for providing transducer response to wave motions in each respective one of four quadrants of said plate means, each one of the transducers of a respective pair being coupled to a respective one of diametrically opposite quadrants of the plate and wherein the subtractive combining means for each transducer pair produces a respective sine-like and cosine-like resultant signal relative to the direction of said sound wave travel propagation transversing said plate.

8. A directional transducer for use in a fluid sound transmission medium, comprising:

a first and second transducer means, each one of said transducer means for providing electrical output signals in response to mechanical stresses applied thereto and for providing mechanical stresses in response to electrical signals applied thereto the first and second transducer means being identical to each other for providing identical output signals in response to substantially identically applied stresses and for providing substantially identical stresses in response to substantially identical electrical signals;

a plate for providing a velocity of sound travel greater than said velocity in the fluid transmission medium and having a surface with a center point and coupled to the fluid transmission medium and to the first and second transducer means, said first and second transducer means having a spaced-apart relationship and each one located diametrically opposite the center point and equal-distant therefrom, for providing stresses in said transducer means in response to sound wave propagation in the fluid transmission medium in planes substantially parallel to said surface and for providing sound wave propagation in the fluid transmission medium in planes substantially parallel to said surface in response to stresses in the first and second transducer means; and substractive combining means including terminals for supplying output signals and accepting input signals and electrically coupled to the first and second transducer means respectively for combining the electrical output signals provided by said first and second transducer means and for providing a combined output signal at said terminals and for accepting input signals at said terminals and for providing electrical signals to said first and second transducer means respectively, said combined output signal having a maximum level when the first and second transducer means are subjected to respective mechanical stresses out of phase with respect to each other and having a minimum level when said stresses are in phase, said accepted input signal providing mechanical stresses in said first and second transducer means respectively, which stresses are out of phase with respect to each other whereby the transducer combination provides a bidirectional planar pattern in a plane substantially parallel to said surface of the plate.

* * * * *